US012708205B2

(12) United States Patent
Li et al.

(10) Patent No.: US 12,708,205 B2
(45) Date of Patent: Aug. 18, 2026

(54) DEVICE FOR RETRACTING SEAT LEG AT ANGLE, SEAT SUPPORT, AND SEAT UNIT

(71) Applicant: Remacro Technology Co., Ltd., Suzhou (CN)

(72) Inventors: Xiaohong Li, Suzhou (CN); Xiaoqiang Zhang, Suzhou (CN); Zhanzheng Lv, Suzhou (CN); Yuankun Li, Suzhou (CN)

(73) Assignee: Remacro Technology Co., Ltd., Suzhou (CN)

( * ) Notice: Subject to any disclaimer, the term of this patent is extended or adjusted under 35 U.S.C. 154(b) by 282 days.

(21) Appl. No.: 18/427,856

(22) Filed: Jan. 31, 2024

(65) Prior Publication Data

US 2024/0164527 A1 May 23, 2024

Related U.S. Application Data

(63) Continuation of application No. PCT/CN2022/080372, filed on Mar. 11, 2022.

(30) Foreign Application Priority Data

Aug. 18, 2021 (CN) ..... 202110949721.7
Aug. 18, 2021 (CN) ..... 202121940526.X
Aug. 18, 2021 (CN) ..... 202121962208.3

(51) Int. Cl.
*A47C 1/0355* (2013.01)
*A47C 7/50* (2006.01)
*A47C 17/86* (2006.01)

(52) U.S. Cl.
CPC ..... *A47C 1/0355* (2013.01); *A47C 7/5068* (2018.08); *A47C 17/86* (2013.01)

(58) Field of Classification Search
CPC ..... A47C 1/034; A47C 1/0355; A47C 1/035; A47C 7/5068; A47C 17/86
See application file for complete search history.

(56) References Cited

U.S. PATENT DOCUMENTS 3,100,668 A 8/1963 Rogers et al.
9,314,099 B2 * 4/2016 Huang ..... A47C 1/0355
(Continued)

FOREIGN PATENT DOCUMENTS

CN 202820377 U 3/2013
CN 104068657 A 10/2014
(Continued)

OTHER PUBLICATIONS

International search report of PCT Patent Application No. PCT/CN2022/080372 issued on May 30, 2022.
(Continued)

*Primary Examiner* — Chi Q Nguyen

(57) ABSTRACT

A device for retracting seat leg at angle, including a leg assembly hinged to a front end of a seat frame mount, both the footrest driving link and the footrest driven link of the leg assembly are hinged to a front end of the seat frame mount respectively, an end of the first footrest link is hinged to the footrest driving link, an opposite end thereof is hinged to an end of the footrest member, an end of the second footrest link is hinged to the footrest driven link, an opposite end thereof is hinged to a middle of the footrest member including a footrest plate mounting surface used to mount a footrest plate, and the footrest plate mounting surface is retracted below the seat frame mount and is oblique with respect to a horizontal plane when the leg assembly is retracted to a limit position.

13 Claims, 5 Drawing Sheets

(56) References Cited

U.S. PATENT DOCUMENTS

| | | | | |
|---|---|---|---|---|
| 10,842,274 | B1 * | 11/2020 | Crawford | A47C 1/0345 |
| 11,517,109 | B2 * | 12/2022 | Browning | A47C 1/03211 |
| 11,700,942 | B2 * | 7/2023 | Li | A47C 17/04 297/85 R |
| 2015/0282619 | A1 * | 10/2015 | Lawson | A47C 1/0355 297/83 |
| 2015/0289655 | A1 * | 10/2015 | Lawson | A47C 1/0342 297/75 |
| 2016/0022040 | A1 * | 1/2016 | Lawson | A47C 1/03211 297/68 |
| 2016/0106220 | A1 * | 4/2016 | Bryant | A47C 3/027 297/423.28 |
| 2018/0027968 | A1 * | 2/2018 | Lawson | A47C 1/0355 |
| 2018/0094711 | A1 * | 4/2018 | Lawson | F16H 25/20 |
| 2018/0242740 | A1 * | 8/2018 | Lawson | A47C 1/0355 |
| 2024/0032693 | A1 * | 2/2024 | Liu | A47C 1/0242 |
| 2024/0122346 | A1 * | 4/2024 | Murphy | A47C 1/0355 |

FOREIGN PATENT DOCUMENTS

| | | | |
|---|---|---|---|
| CN | 104814612 | A | 8/2015 |
| CN | 212546333 | U | 2/2021 |
| CN | 213097053 | U | 5/2021 |
| CN | 213155030 | U | 5/2021 |
| WO | 2009088711 | A1 | 7/2009 |

OTHER PUBLICATIONS

European Search Report of European Patent Application No. 22857245.9 issued on Feb. 7, 2025.

* cited by examiner

DEVICE FOR RETRACTING SEAT LEG AT ANGLE, SEAT SUPPORT, AND SEAT UNIT

CROSS-REFERENCE TO RELATED APPLICATIONS

The present application is a Continuation Application of PCT Application No. PCT/CN2022/080372 filed on Mar. 11, 2022, which claims priority of Chinese Utility Model Application No. 202121962208.3 filed on Aug. 18, 2021 before CNIPA, Chinese Patent Application No. 202110949721.7 filed on Aug. 18, 2021 before CNIPA, and Chinese Utility Model Application No. 202121940526.X filed on Aug. 18, 2021 before CNIPA. All the above are hereby incorporated by reference in their entirety as part of the present disclosure.

FIELD

The present disclosure relates to the technical field of sofa supports and, particularly, a device for retracting seat leg at angle, a seat support, and a seat unit.

BACKGROUND

Functional sofas and chairs are becoming increasingly common in life as people's standard of living improves. Functional seats include loungers, chairs, sofas, combination seats, cinema seats and seating units with mobile seating parts. Functional seats with a retractable mechanism allow adjustment between seating, relaxing and lying positions by means of the retractable mechanism.

Existing seat units suffer from the following deficiencies: When a seat type is designed with high support legs and low seat height, the footrests of the leg assembly are prone to rubbing against the floor, affecting the user's utilization. It's difficult to clean the narrow space at a bottom of the seat frame. In a retracted seating position, the footrests of the leg assembly are retracted in front of the seat, resulting in a thick and heavy upholstery in front of the seat, poor aesthetics, and an inability to place lower legs obliquely under the seat when seated. In a lying position with a leg part and backrest fully extended, a height of the footrest part is usually lower than a height of the backrest, so that the user has a feeling of sliding down when in a lying position, which prevents the body from completely relaxing, causing lower back pain when lying down for a long period. Therefore, it is necessary to provide a seat support structure based on the prior art, which allows for a thinner thickness in the front of the seat, a larger amount of space below the seat frame, and a support structure that allows the body to relax completely.

SUMMARY

In order to solve the problems mentioned above, provided in the present disclosure is a device for retracting seat leg at angle, including a leg assembly hinged to a front end of a seat frame mount of a seat.

The leg assembly includes a footrest driving link, a footrest driven link, a first footrest link, a second footrest link, and a footrest member, in which the footrest driving link and the footrest driven link are hinged to a front end of the seat frame mount respectively, an end of the first footrest link is hinged to the footrest driving link, an opposite end of the first footrest link is hinged to an end of the footrest member, an end of the second footrest link is hinged to the footrest driven link, and an opposite end of the second footrest link is hinged to a middle of the footrest member.

The footrest member includes a footrest plate mounting surface used to mount a footrest plate, in which the footrest plate mounting surface is retracted below the seat frame mount and is oblique with respect to a horizontal plane when the leg assembly is retracted to a limit position.

Further, an included angle between the footrest plate mounting surface and a horizontal plane is 20°-26° when the leg assembly is retracted to a limit position.

Further, a distance from a connecting point between the second footrest link and the footrest member to the footrest plate mounting surface is less than a distance from a connecting point between the first footrest link and the footrest member to the footrest plate mounting surface.

Further, a restricting member is provided on an end of the first footrest link proximal to the footrest member, and the second footrest link is provided with a first restricting surface cooperated with the restricting member; a current position of the leg assembly is a limit position that the leg assembly is extended to, when the first restricting surface is abutted against the restricting member.

Further, a lower edge of the footrest member is provided with a second restricting surface cooperated with the restricting member, and a current position of the leg assembly is a limit position that the leg assembly is retracted to, when the second restricting surface is abutted against the restricting member.

Provided in the present disclosure is a seat support, including a seat frame mount, a seat linkage assembly, a driving connecting member, and a leg angled retracting device, in which the leg angled retracting device includes a leg assembly hinged to a front end of a seat frame mount of a seat, the seat linkage assembly is rotatably connected below the seat frame mount, and the driving connecting member is connected to an end of the seat linkage assembly distal to the leg angled retracting device.

The leg assembly includes a footrest driving link, a footrest driven link, a first footrest link, a second footrest link, and a footrest member, in which the footrest driving link and the footrest driven link are hinged to a front end of the seat frame mount respectively, an end of the first footrest link is hinged to the footrest driving link, an opposite end of the first footrest link is hinged to an end of the footrest member, an end of the second footrest link is hinged to the footrest driven link, an opposite end of the second footrest link is hinged to a middle of the footrest member, and the footrest member includes a footrest plate mounting surface used to mount a footrest plate. The footrest member includes a footrest plate mounting surface used to mount a footrest plate, in which the footrest plate mounting surface is retracted below the seat frame mount and is oblique with respect to a horizontal plane when the leg assembly is retracted to a limit position.

An interior side of the seat frame mount is provided with a mounting platform, in which a height of the mounting platform is lower than an upper edge of the seat frame mount, and a plane where the mounting platform is positioned is a seat frame mounting surface; and a vertical distance H1 between a highest point where the seat frame mount is positioned on the seat frame mounting surface and a lowest point of the driving connecting member is not greater than 270 mm.

Further, a vertical distance H2 between a highest point where the seat frame mount is positioned on the seat frame mounting surface and a highest point of the footrest plate mounting surface is not greater than 50 mm when the seat support is retracted to a limit position.

Further, the seat linkage assembly includes a leg link and a seat frame linkage assembly, the seat linkage assembly is connected to the leg assembly by means of the leg link, and the seat frame linkage assembly includes a first frame link, an intermediate linkage rod and a second frame link all hinged in sequence.

The first frame link and the second frame link are hinged to the seat frame mount respectively, the first frame link, the intermediate linkage rod, the second frame link, and the seat frame mount constitute a four-link mechanism, and the leg link is hinged to the intermediate linkage rod.

Further, the seat linkage assembly further includes a lateral plate linkage assembly, the lateral plate linkage assembly includes a mounting lateral plate and a translating linkage assembly, and the translating linkage assembly is hinged between the seat frame linkage assembly and the mounting lateral plate.

Further, the translating linkage assembly includes a first link, a second link, a first crank, a first intermediate link, a second intermediate link, and a second crank.

An end of the first link is hinged to the first crank, an opposite end of the first link is hinged to the intermediate linkage rod, an end of the second link is hinged to the second crank, and an opposite end of the second link is hinged to the intermediate linkage rod.

The first crank and the second crank are hinged to a front end and a middle of the mounting lateral plate respectively, and the first intermediate link and the second intermediate link are hinged between the first crank and the second crank.

Provided in the present disclosure is further a seat unit, including a seat frame mount, a seat linkage assembly, a driving connecting member, a leg angled retracting device, and a backrest assembly, in which the leg angled retracting device includes a leg assembly hinged to a front end of a seat frame mount of a seat, the seat linkage assembly is rotatably connected below the seat frame mount, the driving connecting member is connected to an end of the seat linkage assembly distal to the leg angled retracting device, the backrest assembly includes a backrest mounting member, and the backrest mounting member is used to connect and adjust a seat backrest.

The leg assembly includes a footrest driving link, a footrest driven link, a first footrest link, a second footrest link, and a footrest member, in which the footrest driving link and the footrest driven link are hinged to a front end of the seat frame mount respectively, an end of the first footrest link is hinged to the footrest driving link, an opposite end of the first footrest link is hinged to an end of the footrest member, an end of the second footrest link is hinged to the footrest driven link, an opposite end of the second footrest link is hinged to a middle of the footrest member, and the footrest member includes a footrest plate mounting surface used to mount a footrest plate.

When the seat unit is in a seated position, the leg assembly is retracted to a limit position, the footrest plate mounting surface is retracted below the seat frame mount and is oblique with respect to a horizontal plane; and when the seat unit is in a lying position, a highest point of the seat frame mount is higher than a highest point of the backrest mounting member.

Further, the backrest assembly further includes a seat frame connecting part, a backrest connecting member, and a backrest restricting member.

A middle of the seat frame connecting part is fixedly connected to the seat frame mount, both ends of the seat frame connecting part are hinged to the backrest mounting member and the backrest restricting member respectively, an end of the backrest connecting member is hinged to a middle of the backrest mounting member, an opposite end of the backrest connecting member is hinged to the backrest restricting member, and the backrest restricting member is hinged to a back end of a mounting lateral plate by means of a connecting rod.

When the seat frame connecting part and the seat frame mount are moved forward and upward obliquely, the backrest restricting member and the backrest connecting member drive the backrest mounting member to rotate backward.

Further, a distance H3 between the footrest plate mounting surface and a highest point of the backrest mounting member is not less than 300 mm, when the seat unit is in a lying position.

Further, a maximum adjustable angle of the backrest mounting member is not less than 45°, when the seat unit is adjusted from an extending position to a lying position.

Further, an included angle β between a central line of the backrest mounting member and a horizontal plane is not greater than 20°, when the seat unit is in a lying position.

BRIEF DESCRIPTION OF THE DRAWINGS

In order to illustrate the technical solutions of the present disclosure more clearly, the following drawings are briefly introduced as required in the context of the embodiments or the prior art. Obviously, the following drawings illustrate only some of the embodiments of the present disclosure. Other relevant drawings may be obtained on the basis of these drawings without any creative effort by those skilled in the art.

Figure 1:
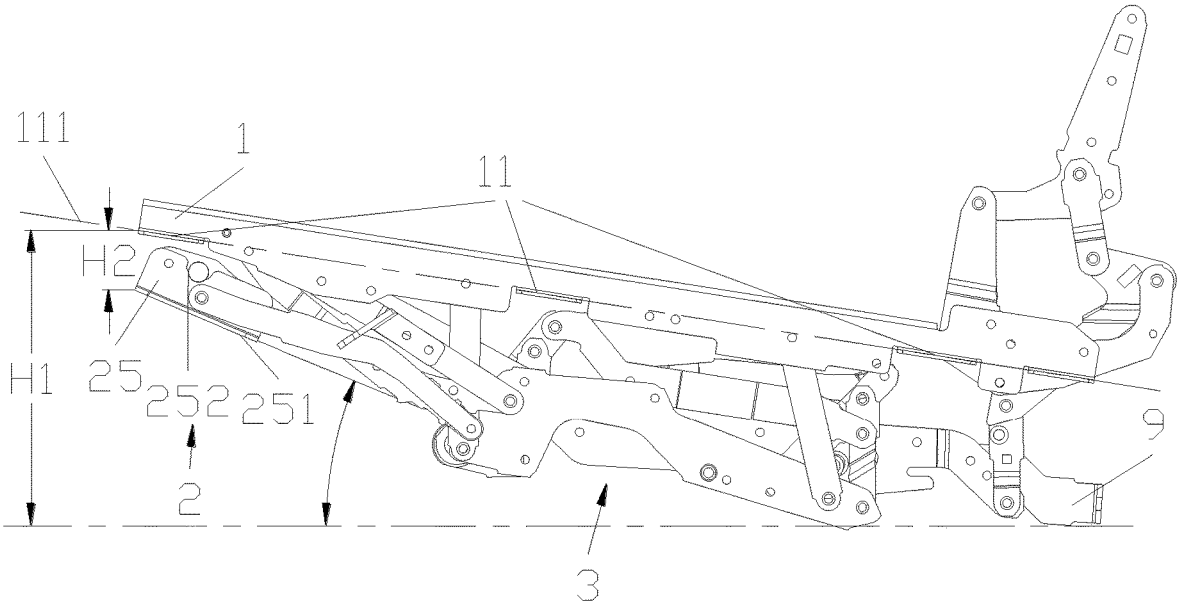
FIG. 1 is a structural diagram of the seat support of the embodiment of the present disclosure.

Labels: 10 seat support; 1 seat frame mount; 11 mounting platform; 111 seat frame mounting surface; 2 leg assembly; 21 footrest driving link; 22 footrest driven link; 23 first footrest link; 231 restricting member; 24 second footrest link; 241 first restricting surface; 25 footrest member; 251 footrest plate mounting surface; 252 second restricting surface; 3 seat linkage assembly; 31 leg link; 32 seat frame linkage assembly; 321 first frame link; 322 intermediate linkage rod; 323 second frame link; 33 lateral plate linkage assembly; 331 mounting lateral plate; 332 translating linkage assembly; 333 first link; 334 second link; 335 first crank; 336 first intermediate link; 337 second intermediate link; 338 second crank; 4 seat frame; 5 armrest frame; 6 footrest plate; 7 seat support leg; 8 backrest assembly; 81 backrest mounting member; 82 seat frame connecting part; 83 backrest connecting part; 84 backrest restricting member; 85 connecting rod; 9 driving connecting member; 100 seat backrest; 101 backrest rear edge.

DETAILED DESCRIPTION OF THE EMBODIMENTS

The technical solutions in the embodiments of the present disclosure are clearly and completely described and discussed below in conjunction with the attached drawings of the embodiments of the present disclosure. Obviously, the embodiments described herein are only some of the embodiments of the present disclosure but not all of them. Based on the embodiments in the present disclosure, all other embodiments obtained by those skilled in the art without creative efforts fall within the scope of protection of the present disclosure.

References herein to "an embodiment" or "embodiments" refer to particular features, structures or characteristics that may be included in at least one embodiment of the present disclosure. In the description of the present disclosure, it is to be understood that the terms "up", "down", "front", "back", and other orientation or position relationships are based on the orientation or position relationships shown in the attached drawings. It is only intended to facilitate description of the present disclosure and simplify description, but not to indicate or imply that the referred device or element has a specific orientation, or is constructed and operated in a specific orientation. Therefore, they should not be construed as a limitation of the present disclosure. Furthermore, the related terms "first", and "second" are used for descriptive purposes only and are not to be understood as indicating or implying relative importance or implicitly specifying the number of technical features indicated. As a result, a feature defined as "first" or "second" may expressly or implicitly include one or more such features. The terms "first", "second" and the like are used to identify different objects and are not intended to describe a particular sequence or order. It should be understood that the data herein used may be interchangeable in appropriate cases so that the embodiment of the present disclosure described herein may be implemented in an order other than what is illustrated or described herein.

In the present disclosure, unless otherwise explicitly specified and limited, the term "mount", "connect" and the like should be understood in a broad sense, for example, as a fixed connection, as a detachable connection, as an integral connection, as a mechanical connection, as an electrical connection, as a direct connection, as an indirect connection through an intermediate medium, or as a connection within two elements. For those skilled in the art, the specific meaning of the above terms in the context of the present invention may be understood according to the specific situation.

In view of the problems mentioned above of the prior art, an objective of the present disclosure is to provide a device for retracting seat leg at angle, a seat support, and a seat unit, which allows the structure of the seat frame mount and leg assembly to be adjusted so that a vertical height of a front of the seat is reduced after retraction, a thickness of the seat is thinner, an inclination angle of the seat is increased in a lying position, and the space at a bottom of the seat frame is increased so that a height of the seat legs is increased and the bottom is easy to be cleaned.

Embodiment 1

The seat of the present embodiment is capable of being adjusted between sitting, extending and lying positions, with the seat being adjusted from a sitting position to an extending position as a first adjustment stage, and the seat being adjusted from an extending position to a lying position as a second adjustment stage. In the first adjustment stage, the angle of the seat backrest is maintained substantially unchanged, and the leg assembly is extended forward to a limit position. In the second adjustment stage, the leg assembly and the seat frame move upward obliquely as a whole, and the seat backrest is rotated backward, so that an angle between the backrest and the seat frame is increased until it is finally adjusted to a lying position.

Figure 2:
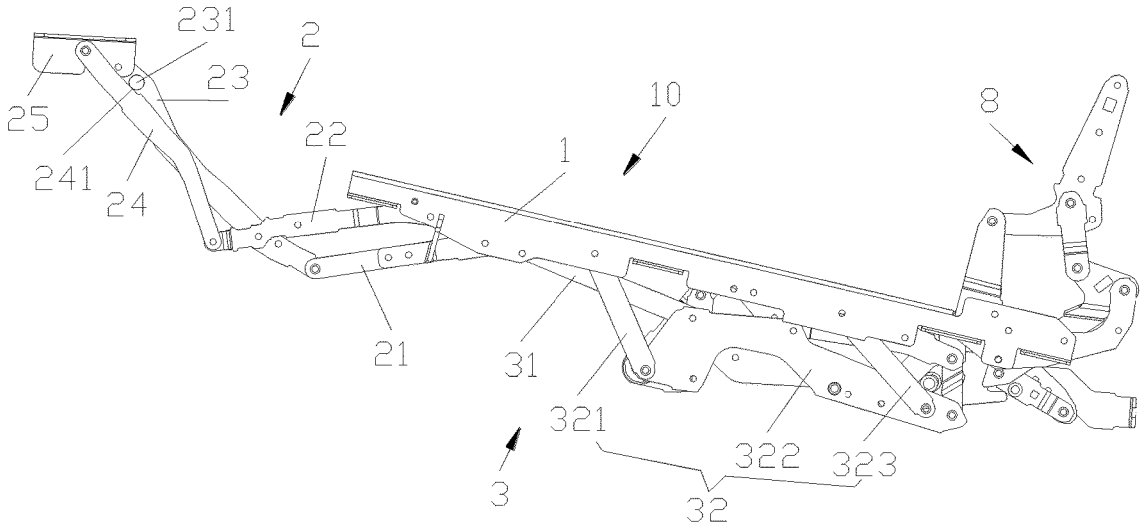
FIG. 2 is a structural diagram of the seat support of the embodiment of the present disclosure in an extending position.

As shown in FIGS. 1-2, provided in the embodiment 1 is a device for retracting seat leg at angle, including a leg assembly 2 hinged to a front end of the seat frame mount 1. The leg assembly 2 includes a footrest driving link 21, a footrest driven link 22, a first footrest link 23, a second footrest link 24, and a footrest member 25, in which the footrest driving link 21 and the footrest driven link 22 are hinged to a front end of the seat frame mount 1 respectively, an end of the first footrest link 23 is hinged to the footrest driving link 21, an opposite end of the first footrest link 23 is hinged to an end of the footrest member 25, an end of the second footrest link 24 is hinged to the footrest driven link 22, and an opposite end of the second footrest link 24 is hinged to a middle of the footrest member 25.

The footrest member 25 includes a footrest plate mounting surface 251 used to mount a footrest plate 6, in which the footrest plate mounting surface 251 is retracted below the seat frame mount 1 and is oblique with respect to a horizontal plane when the leg assembly 2 is retracted to a limit position. Specifically, an included angle between the footrest plate mounting surface 251 and a horizontal plane is 20°-26° when the leg assembly 2 is retracted to a limit position. Preferably, the included angle mentioned above may be 20°, 23°, 25°, or 26°. A distance from a connecting point between the second footrest link 24 and the footrest member 25 to the footrest plate mounting surface 251 is less than a distance from a connecting point between the first footrest link 23 and the footrest member 25 to the footrest plate mounting surface 251, so that the footrest member 25 is retracted and oblique with respect to a horizontal plane, and the leg angled retracting device occupies less space in a vertical direction.

Specifically, a restricting member 231 is provided on an end of the first footrest link 23 proximal to the footrest member 25. The second footrest link 24 is provided with a first restricting surface 241 cooperated with the restricting member 231, and a current position of the leg assembly 2 is a limit position that the leg assembly 2 is extended to, when the first restricting surface 241 is abutted against the restricting member 231. A lower edge of the footrest member 25 is provided with a second restricting surface 252 cooperated with the restricting member 231, and a current position of the leg assembly 2 is a limit position that the leg assembly 2 is retracted to, when the second restricting surface 252 is abutted against the restricting member 231. Specifically, the restricting member 231 is cooperated with and abutted against the first restricting surface 241 or the second restricting surface 252, which plays a role in restricting positions and preventing the footrest member from loosening. On the on hand, it may restrict positions to prevent the leg assembly from not retracting or unfolding smoothly due to excessive extension or retraction; on the other hand, it may prevent the footrest member and the footrest plate from easily loosening as they do not retract to a predetermined limit position.

The footrest member of the present embodiment is fully retracted obliquely below the seat frame mount. The front of the finished seat of the present disclosure is thinner and lighter as compared to a conventional seat with a leg structure in which a footrest member is vertical when retracted. A vertical height of both the seat frame mount 1 and the leg assembly 2 is compressed after the seat support is retracted, which minimizes the amount of space taken up when retracted, which minimizes a thickness and space taken up by the retracted support and improves the space utilization, which results in an increase of space in a lower part of the seat frame after the seat is fully assembled, which facilitates cleaning by cleaning devices, such as mops, sweepers, and so on. Also, the leg part may be retracted inward obliquely to add more to the sitting experience when sitting.

Provided in the present embodiment is seat support, including a seat frame mount 1, a seat linkage assembly 3, a driving connecting member 9, and a leg angled retracting device, in which the seat linkage assembly 3 is rotatably connected below the seat frame mount 1, and the driving connecting member 9 is connected to an end of the seat linkage assembly 3 distal to the leg angled retracting device. An interior side of the seat frame mount 1 is provided with a mounting platform 11, in which a height of the mounting platform 11 is lower than an upper edge of the seat frame mount 1, and a plane where the mounting platform 11 is positioned is a seat frame mounting surface 111. As shown in FIG. 1, a vertical distance H1 between a highest point where the seat frame mount 1 is positioned on the seat frame mounting surface 111 and a lowest point of the driving connecting member 9 is not greater than 270 mm, and preferably may be 270 mm, 260 mm, 250 mm, 230 mm, 220 mm, or 200 mm.

It should be noted that there may be a plurality of mounting platforms 11. In the present embodiment, the mounting platforms 11 are provided on a lower edge of the seat frame mount 1. Four mounting platforms 11 are provided in a length direction of the seat frame mount 1. The seat frame may be fixedly mounted on the mounting platforms 11 by means of fasteners such as bolts and nuts, or rivets. A length of the mounting platform 11 of the present disclosure is lowered, so that the seat frame is lowered to be mounted, resulting in a deeper seat depth. With the seat height unchanged and the seat frame mounting surface lowered, a height of the seat legs is increased and the space under the seat frame is increased, which also allows for an increase in the thickness of the seat cushion upholstery and an increase in the level of comfort.

Specifically, a vertical distance H2 between a highest point where the seat frame mount 1 is positioned on the seat frame mounting surface 111 and a highest point of the footrest plate mounting surface 251 is not greater than 50 mm, when the seat support 10 is retracted to a limit position. Preferably, a vertical distance H2 between a highest point where the seat frame mount 1 is positioned on the seat frame mounting surface 111 and a highest point of the footrest plate mounting surface 251 may be 50 mm, 45 mm, or 40 mm. The less the distance H2 is, the thinner the seat is when viewed from the front of the seat after the leg assembly is retracted.

Figure 3:
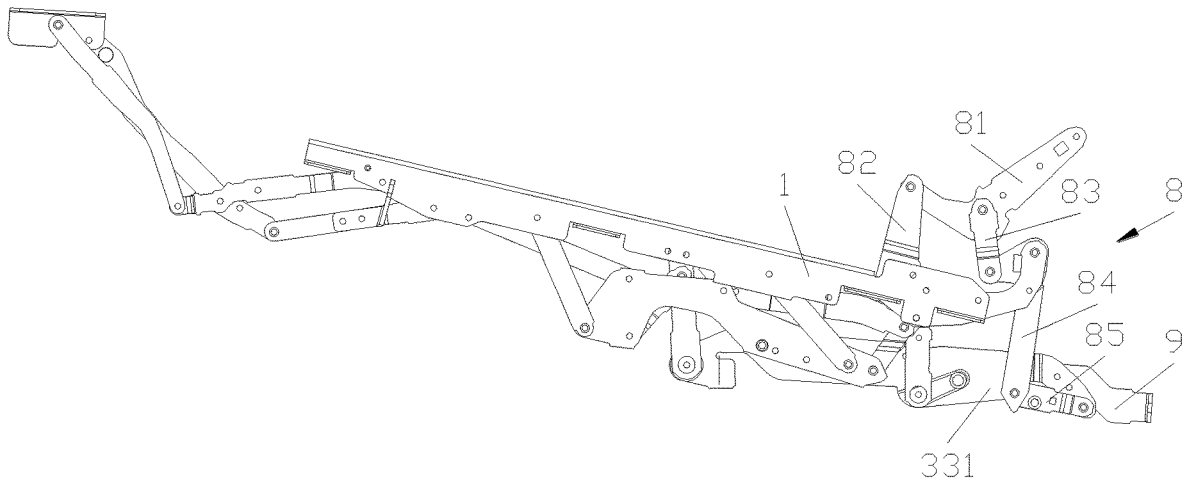
FIG. 3 is a structural diagram of the seat support of the embodiment of the present disclosure in a lying position.

Specifically, as shown in FIG. 3, the seat linkage assembly 3 in the present embodiment includes a leg link 31 and a seat frame linkage assembly 32, the seat linkage assembly 3 is connected to the leg assembly 2 by means of the leg link 31, and the seat frame linkage assembly 32 includes a first frame link 321, an intermediate linkage rod 322 and a second frame link 323 all hinged in sequence. The first frame link 321 and the second frame link 323 are hinged to the seat frame mount 1 respectively, the first frame link 321, the intermediate linkage rod 322, the second frame link 323 and the seat frame mount 1 constitute a four-link mechanism, and the intermediate linkage rod 322 is hinged to the leg link 31. In the present embodiment, in the first adjustment stage, the intermediate linkage rod 322 is maintained unchanged, and the seat frame mount 1 is translated forward with the extension of the leg assembly 2 until the leg assembly 2 is fully extended by means of the rotation of both the first frame link 321 and the second frame link 323.

Figure 4:
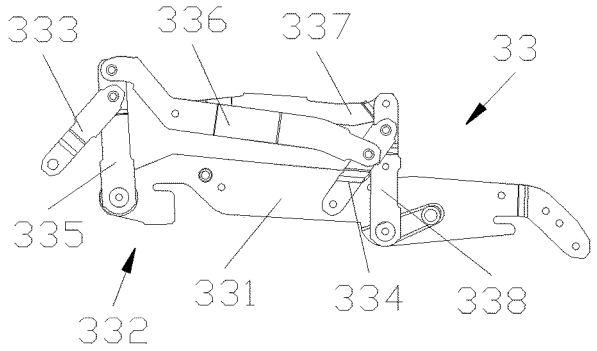
FIG. 4 is a structural diagram of the lateral plate linkage assembly of the embodiment of the present disclosure.

Specifically, as shown in FIG. 4, the seat linkage assembly 3 further includes a lateral plate linkage assembly 33, the lateral plate linkage assembly 33 includes a mounting lateral plate 331 and a translating linkage assembly 332, and the translating linkage assembly 332 is hinged between the seat frame linkage assembly 32 and the mounting lateral plate 331. In the second adjustment stage, the seat frame linkage assembly 32 is translated forward and upward obliquely by means of the movement of the translating linkage assembly 332. The translating linkage assembly 332 includes a first link 333, a second link 334, a first crank 335, a first intermediate link 336, a second intermediate link 337, and a second crank 338, in which an end of the first link 333 is hinged to the first crank 335, an opposite end of the first link 333 is hinged to the intermediate linkage rod 322, an end of the second link 334 is hinged to the second crank 338, and an opposite end of the second link 334 is hinged to the intermediate linkage rod 322; and the first crank 335 and the second crank 338 are hinged to a front end and a middle of the mounting lateral plate 331 respectively, and the first intermediate link 336 and the second intermediate link 337 are hinged between the first crank 335 and the second crank 338.

Specifically, the seat support 10 further includes a backrest assembly 8, in which the backrest assembly 8 is rotatably connected to an end of the seat frame mount 1 distal to the leg assembly, the backrest assembly 8 is used to be connected to the seat backrest and used to adjust an angle of the seat backrest. The backrest assembly 8 further includes a backrest mounting member 81, a seat frame connecting part 82, a backrest connecting member 83, and a backrest restricting member 84. A middle of the seat frame connecting part 82 is fixedly connected to the seat frame mount 1, both ends of the seat frame connecting part 82 are hinged to the backrest mounting member 81 and the backrest restricting member 84 respectively, an end of the backrest connecting member 83 is hinged to a middle of the backrest mounting member 81, an opposite end of the backrest connecting member 83 is hinged to the backrest restricting member 84, and the backrest restricting member 84 is hinged to a back end of a mounting lateral plate 331 by means of a connecting rod 85. When the seat frame connecting part 82 and the seat frame mount 1 are moved forward and upward obliquely, the backrest restricting member 84 and the backrest connecting member 83 drive the backrest mounting member 81 to rotate backward.

In the present embodiment, in the first adjustment stage, the leg assembly 2 is extended forward to drive the seat frame mount 1 to move forward, the intermediate linkage rod 322 remains motionless, and the first frame link 321 and the second frame link 323 are rotated forward, at which time an angle between the seat frame and the backrest remains unchanged. In the second adjustment stage, the leg assembly 2, the seat frame mount 1 and the seat frame linkage assembly 32 as a whole are moved forwardly and upwardly at an angle, at which time the seat backrest is rotated and adjusted backwardly and the angle between the backrest and the seat frame is increased.

Figure 6:
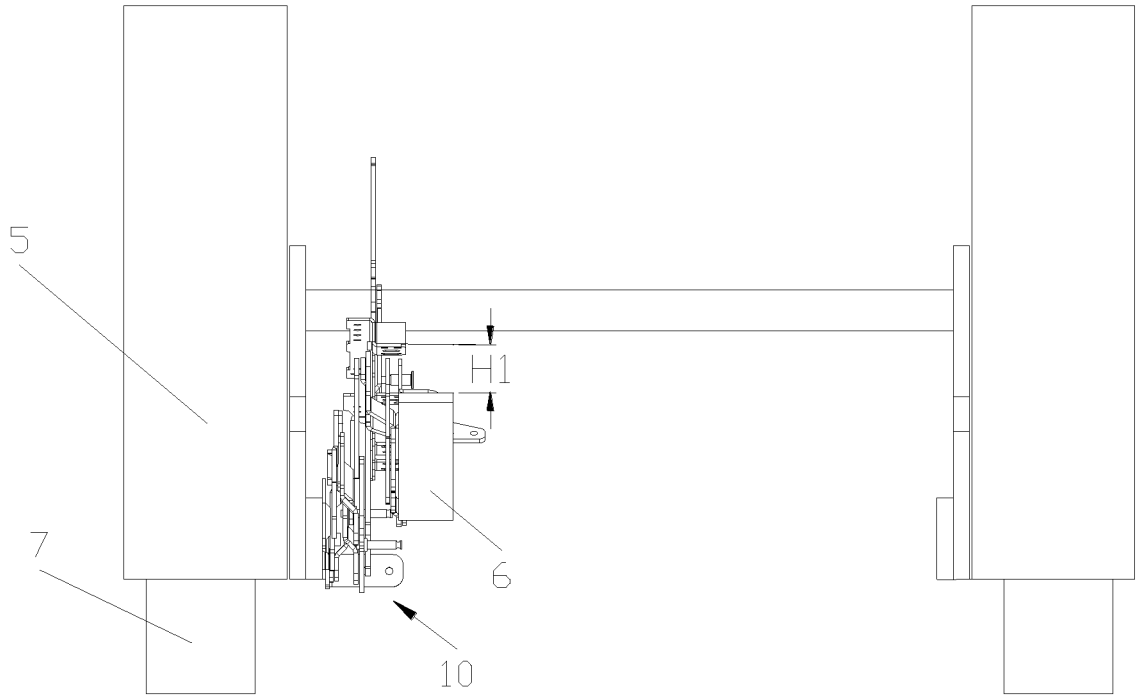
FIG. 6 is a front view of the seat unit in embodiment 1 of the present disclosure.
Figure 7:
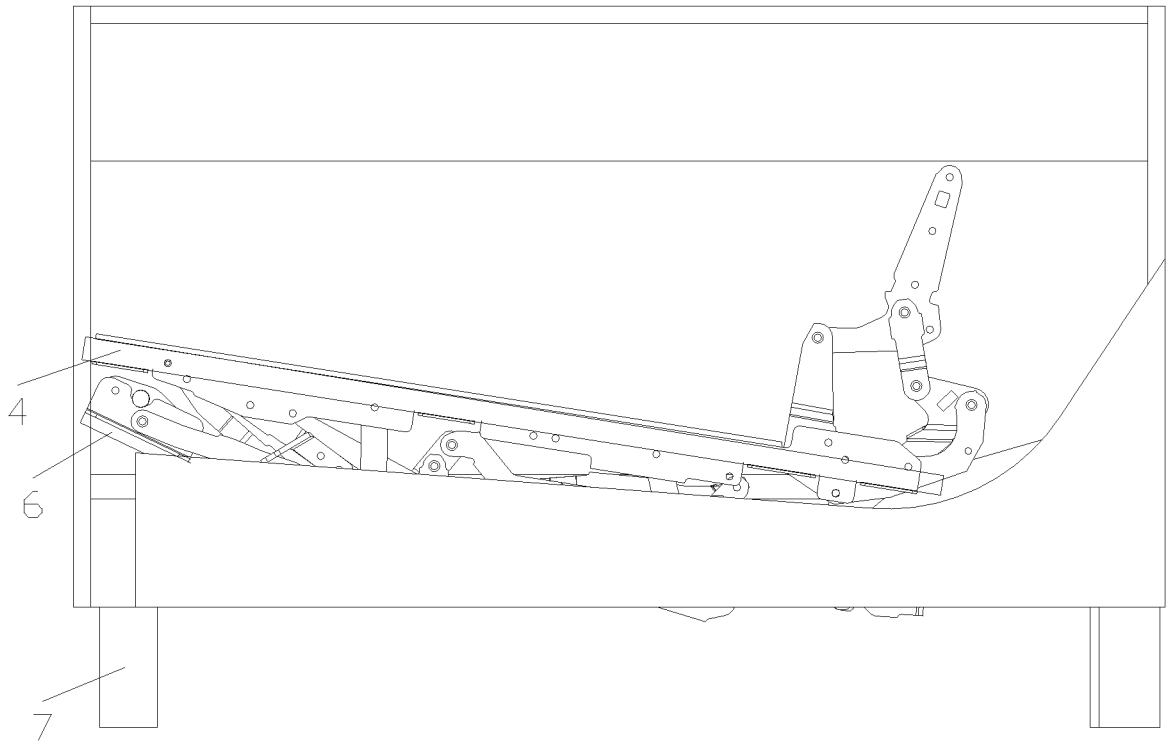
FIG. 7 is a side view of the seat unit in embodiment 1 of the present disclosure.

As shown in FIGS. 6-7, provided in the present embodiment is further a seat unit, including two sets of seat support 10 arranged oppositely. A driving assembly is provided between two sets of the seat support 10, in which the driving assembly includes a driving crossbar and a fixed crossbar, the driving crossbar is provided between two leg assemblies arranged oppositely, the fixed crossbar is connected between two mounting lateral plates 331 arranged oppositely by means of the driving connecting member 9, and the driving crossbar is used to connect with a push rod of a driving source, so that the driving crossbar drives the seat support 10 to move between the sitting position and the lying position. Specifically, the driving assembly drives the leg assembly 2 to extend by means of the driving crossbar, so as to drive the seat frame mount 1, the seat linkage assembly 3 and the backrest assembly 8 to move. Under the drive of the driving assembly, the seat unit of the present embodiment may achieve three positions, i.e., sitting position, extending position and lying position. In the sitting position, both the leg assembly 2 and the backrest assembly 8 are retracted to a limit position. In the extending position, the leg assembly 2 is extended forward to a limit position, and an angle between the backrest assembly 8 and the seat frame 4 is kept the same as that in the sitting position. In the lying position, the leg assembly 2 is extended to a limit position, and the backrest assembly 8 is rotated backward to a limit position.

Two seat supports 10 of the seat unit are fixedly connected to inner surfaces of two armrest frames 5 respectively, and the seat frame 4 is provided between two seat frame mounts 1 by means of a mounting platform 11. Specifically, the two seat supports 10 are provided mirrored and spaced apart and are fixed to the armrest frame 5 by means of a mounting lateral plate 331. The seat frame 4 is lowered and mounted on a mounting platform 11, and a height of the mounting platform 11 is lower than an upper edge of the seat frame mount 1.

Figure 5:
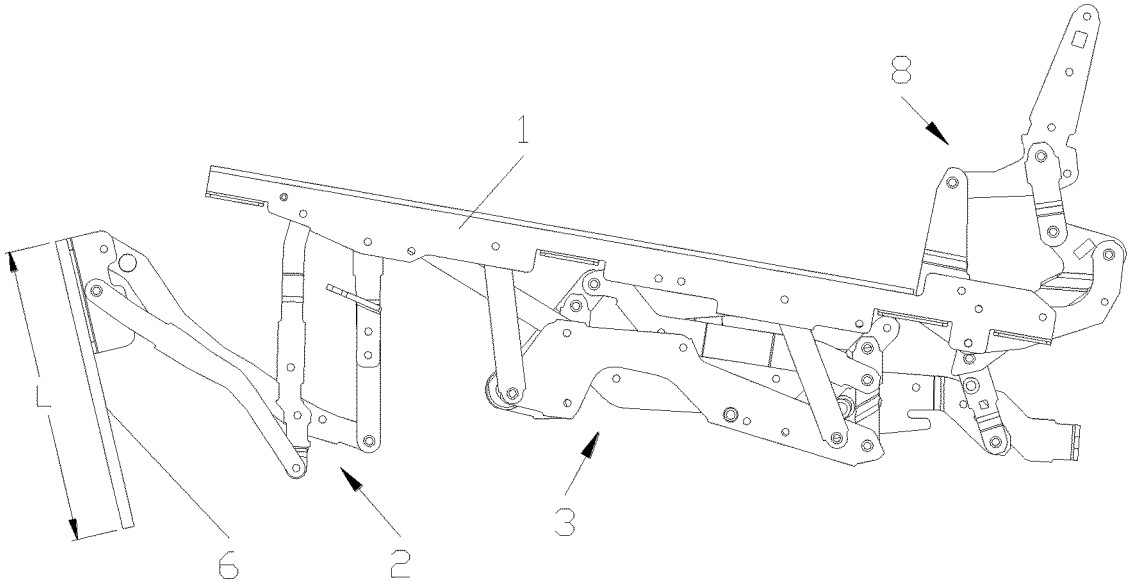
FIG. 5 is a structural diagram of the seat support of the embodiment of the present disclosure during extension.

Specifically, as shown in FIG. 5, the seat unit further includes a footrest plate 6, in which the footrest plate 6 is connected to the footrest plate mounting surface 251 by means of fasteners, and a length L of the footrest plate 6 is not less than 200 mm. Since the footrest member of the present embodiment is capable of retracting at an angle below the leg assembly 2, a relatively long footrest plate 6 may be mounted. Preferably, on the basis that the footrest plate has no interference with the ground during retraction of the leg assembly, the length L of the footrest plate 6 may be 200 mm, 250 mm, 260 mm, or 280 mm.

Specifically, the seat unit further includes a seat support leg 7, the seat support leg 7 is provided below the armrest frame 5, and a height of the seat support leg 7 is 120-150 mm. Preferably, the height of the seat support leg 7 may be 120 mm, 130 mm or 150 mm. Compared to a seat unit adopting a conventional seat support, a higher height of the seat legs in the present embodiment allows for a comfortable seat height, which increases the space at a bottom of the seat frame. The conventional seat support takes up a lot of space due to its complex structure, with seat legs of only about 5 mm, and it's not easy to clean up a bottom of the seat.

Embodiment 2

Figure 8:
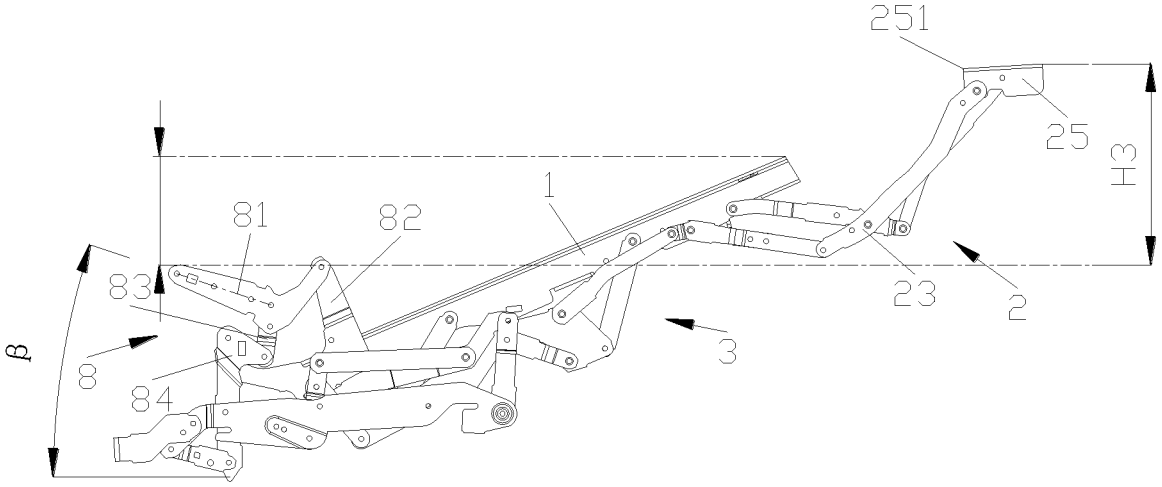
FIG. 8 is a diagram of the seat support in embodiment 2 of the present disclosure in a lying position.
Figure 9:
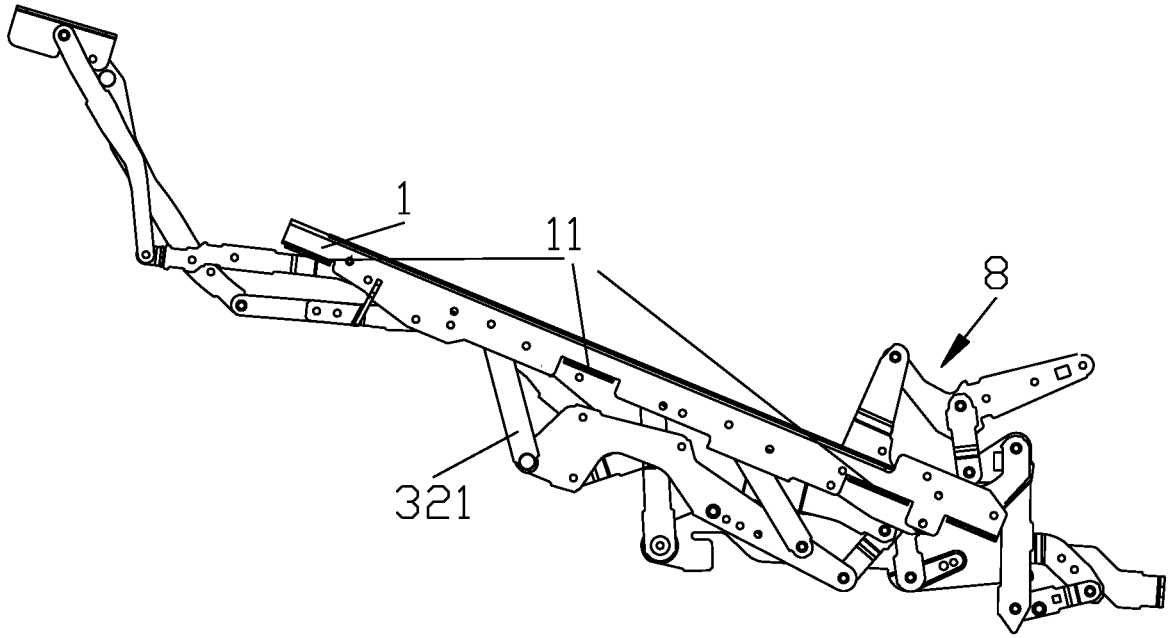
FIG. 9 is a diagram of FIG. 8 from an opposite side.
Figure 10:
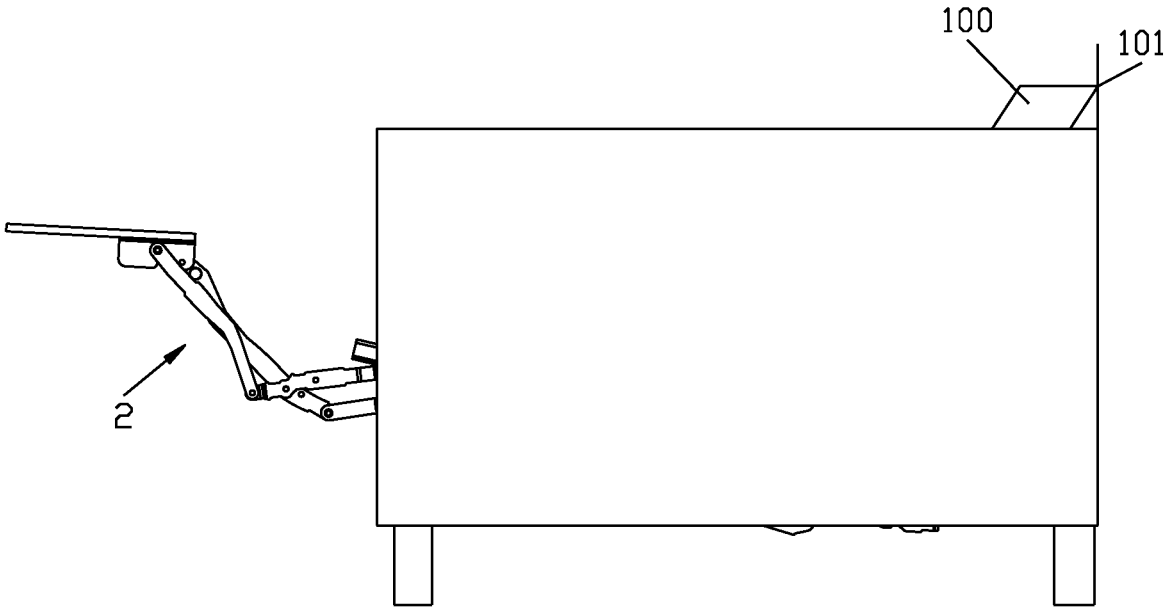
FIG. 10 is a side view of the seat unit in embodiment 2 of the present disclosure.

As shown in FIGS. 8-10, the seat support in embodiment 2 includes a seat frame mount 1, a seat linkage assembly 3, a driving connecting member 9, a leg angled retracting device, and a backrest assembly 8, in which the leg angled retracting device comprises a leg assembly 2 hinged to a front end of a seat frame mount 1 of a seat, the seat linkage assembly 3 is rotatably connected below the seat frame mount 1, the driving connecting member 9 is connected to an end of the seat linkage assembly 3 distal to the leg angled retracting device, the backrest assembly 8 includes a backrest mounting member 81, and the backrest mounting member 81 is used to connect and adjust a seat backrest.

Specifically, the leg assembly 2 includes a footrest driving link 21, a footrest driven link 22, a first footrest link 23, a second footrest link 24, and a footrest member 25, in which the footrest driving link 21 and the footrest driven link 22 are hinged to a front end of the seat frame mount 1 respectively, an end of the first footrest link 23 is hinged to the footrest driving link 21, an opposite end of the first footrest link 23 is hinged to an end of the footrest member 25, an end of the second footrest link 24 is hinged to the footrest driven link 22, an opposite end of the second footrest link 24 is hinged to a middle of the footrest member 25, and the footrest member 25 comprises a footrest plate mounting surface 251 used to mount a footrest plate 6.

When the seat unit is in a seated position, the leg assembly 2 is retracted to a limit position, the footrest plate mounting surface 251 is retracted below the seat frame mount 1 and is oblique with respect to a horizontal plane; and when the seat unit is in a lying position, a highest point of the seat frame mount 1 is higher than a highest point of the backrest mounting member 81.

Specifically, the backrest assembly 8 further includes a seat frame connecting part 82, a backrest connecting member 83, and a backrest restricting member 84. A middle of the seat frame connecting part 82 is fixedly connected to the seat frame mount 1, both ends of the seat frame connecting part 82 are hinged to the backrest mounting member 81 and the backrest restricting member 84 respectively, an end of the backrest connecting member 83 is hinged to a middle of the backrest mounting member 81, an opposite end of the backrest connecting member 83 is hinged to the backrest restricting member 84, and the backrest restricting member 84 is hinged to a back end of a mounting lateral plate 331 by means of a connecting rod 85. When the seat frame connecting part 82 and the seat frame mount 1 are moved forward and upward obliquely, the backrest restricting member 84 and the backrest connecting member 83 drive the backrest mounting member 81 to rotate backward.

In the present embodiment, in the second adjustment stage, the seat frame mount 1 is moved upwardly at an angle, and the backrest mounting member 81 is lowered by rotating backwardly, so that the seat is in a lying position when both the backrest assembly 8 and the leg assembly 2 are adjusted to a limit position, at which time a difference in height H3 between the footrest plate mounting surface 251 and a highest point of the backrest mounting member 81 is not less than 300 mm. Preferably, the difference in height H3 between the footrest plate mounting surface 251 and a highest point of the backrest mounting member 81 may be 300 mm, 310 mm, 320 mm, or 350 mm. In the present embodiment, the difference in height between the footrest plate mounting surface 251 and the backrest mounting member is increased, i.e., a height of the seat footrest part is increased in the lying position, so that the feet and head may be substantially in a horizontal position when lying down, so as to achieve a comfort similar to that of zero gravity in space, and to achieve the purpose of improving the blood circulation, alleviating the pain of the waist and back, and relaxing the body and mind.

It should be noted that, in the second adjustment stage, the leg assembly 2 and the seat linkage assembly 3 are translated upward at an angle, an inclination angle between the seat frame mount 1 and a horizontal plane is increased, the backrest mounting member 81 is driven by both the backrest restricting member 84 and the backrest connecting member 83 to be rotated backward with respect to the seat frame mount 1, and an angle between the backrest mounting member 81 and the seat frame mount 1 is increased. Specifically, a maximum adjustable angle of the backrest mounting member 81 during the second adjustment stage is not less than 45°. Preferably, a range of an angle of the backrest mounting member 81 during the second adjustment stage may be 45°, 48°, 50°, 52°, 55°, or 60°. In the present embodiment, the range the angle of the backrest mounting member 81 during the second adjustment stage is 50°, and an angle between the backrest mounting member 81 and the seat frame mount 1 is adjusted from 117° to 166°. The maximum adjustable angle of the seat frame mount 1 during the second adjustment stage is not less than 8°, and may preferably be 8°, 10°, 12°, or 15°. In the present embodiment, an angle of the seat frame mount 1 varies with a range of 10°, and an angle between the seat frame mount 1 and a horizontal plane ranges from 13° to 23°. In the present embodiment, an included angle β between a central line of the backrest mounting member 81 and a horizontal plane is not greater than 20°, when the seat is adjusted to the lying position. That is, an included angle between the seat backrest and a horizontal plane is not greater than 20°, when adjusted to the lying position. Preferably, the included angle β may be 20°, 18°, or 16°. The angular adjustment of the seat frame mount and backrest assembly eventually results in the seat backrest and footrest being nearly horizontal or the footrest being slightly above the head, allowing the user to have the experience of space-like zero-gravity with increased comfort in the lying position.

The seat backrest 100 of the seat unit in the embodiment 2 includes a backrest rear edge 101. In the sitting position, a plane perpendicular to a horizontal plane in which the backrest rear edge 101 is positioned is an initial plane, and the movement of the backrest rear edge 101 will not exceed the initial plane during the first adjustment stage and the second adjustment stage. Specifically, by adopting the adjustment device of the present embodiment, the seat linkage assembly drives the backrest assembly to move forward obliquely by a distance greater than or equal to a distance generated by the seat backrest rotating backward during the adjustment process, so that the seat backrest may be positioned against the wall with zero clearance, which is more space-saving.

Specifically, the advantages of adopting the seat unit of the above embodiments: The leg assembly in the present disclosure is simple and compact in structure. The footrest member is fully retracted at an angle to a bottom of the seat frame. The combination of the lowering of the seat frame and the angled retraction of the footrest member allows the seat frame and leg assembly to be reduced in size in a vertical direction in a sitting position, resulting in a thinner seat when viewed from the front, and an increase in space at the bottom of the seat frame to allow for easy cleanup.

The seat frame mounting platform of the present disclosure is provided on a lower edge of an inner wall of the seat frame mount, so that the seat frame may be lowered and mounted between two seat frame mounts, resulting in a deeper seat depth. A vertical height of both the seat frame mount and the leg assembly is compressed after the seat support is retracted, which minimizes the amount of space taken up when retracted, allowing the seat support to be applied to seat types with high legs and a low seat height.

In the present disclosure, the structural improvement of the leg assembly and the backrest assembly enables the extension height of the footrest member, the inclination angle of the seat frame mount, and the adjustable angle of the backrest mounting member to be increased accordingly. The user achieves a sense of zero gravity with feet and head roughly level or with feet higher than the head when the seat is in a lying position, which improves the comfort thereof in the lying position.

In view of the technical solutions mentioned above, the present disclosure has beneficial effects as follows.

The leg assembly in the present disclosure is simple and compact in structure. The footrest member is fully retracted at an angle to a bottom of the seat frame. The combination of the lowering of the seat frame and the angled retraction of the footrest member allows the seat frame and leg assembly to be reduced in size in a vertical direction in a sitting position, resulting in a thinner seat when viewed from the front, and an increase in space at the bottom of the seat frame to allow for easy cleanup.

The seat frame mounting platform of the present disclosure is provided on a lower edge of an inner wall of the seat frame mount, so that the seat frame may be lowered and mounted between two seat frame mounts, resulting in a deeper seat depth. A vertical height of both the seat frame mount and the leg assembly is compressed after the seat support is retracted, which minimizes the amount of space taken up when retracted, allowing the seat support to be applied to seat types with high legs and a low seat height. In the present disclosure, the structural improvement of the leg assembly and the backrest assembly enables the extension height of the footrest member, the inclination angle of the seat frame mount, and the adjustable angle of the backrest mounting member to be increased accordingly. The user achieves a sense of zero gravity with feet and head roughly level or with feet higher than the head when the seat is in a lying position, which improves the comfort thereof in the lying position.

In the present disclosure, the "inner" side is between the two facing seat supports, and the "outer" side is in an opposite direction thereof. The extension direction of the leg assembly is "forward" and an opposite direction thereof is "backward".

The foregoing description has sufficiently disclosed specific embodiments of the present disclosure. It should be noted that any changes made to specific embodiments of the present disclosure by those skilled in the art do not depart from the scope of the claims of the present disclosure. Accordingly, the scope of the claims of the present disclosure is not limited to the foregoing specific embodiments.

The invention claimed is:

1. A device for retracting seat leg at angle, comprising a leg assembly hinged to a front end of a seat frame mount of a seat;

the leg assembly comprises a footrest driving link, a footrest driven link, a first footrest link, a second footrest link, and a footrest member, wherein the footrest driving link and the footrest driven link are hinged to a front end of the seat frame mount respectively, an end of the first footrest link is hinged to the footrest driving link, an opposite end of the first footrest link is hinged to an end of the footrest member, an end of the second footrest link is hinged to the footrest driven link, and an opposite end of the second footrest link is hinged to a middle of the footrest member; and the footrest member comprises a footrest plate mounting surface used to mount a footrest plate, wherein the footrest plate mounting surface is configured to be retracted below the seat frame mount and is configured to be oblique with respect to a horizontal plane upon the leg assembly being retracted to a limit position; wherein an included angle between the footrest plate mounting surface and a horizontal plane is configured to be 20°-26° upon the leg assembly being retracted to a limit position; wherein a distance from a connecting point between the second footrest link and the footrest member to the footrest plate mounting surface is less than a distance from a connecting point between the first footrest link and the footrest member to the footrest plate mounting surface.

2. The device for retracting seat leg at angle according to claim 1, wherein a restricting member is provided on an end of the first footrest link proximal to the footrest member, and the second footrest link is provided with a first restricting surface cooperated with the restricting member; a current position of the leg assembly is configured to be a limit position that the leg assembly is extended to upon the first restricting surface being abutted against the restricting member.

3. The device for retracting seat leg at angle according to claim 2, wherein a lower edge of the footrest member is provided with a second restricting surface cooperated with the restricting member, and a current position of the leg assembly is configured to be a limit position that the leg assembly is retracted to upon the second restricting surface being abutted against the restricting member.

4. A seat support, comprising a seat frame mount, a seat linkage assembly, a driving connecting member, and device for retracting seat leg at angle, wherein the device for retracting seat leg at angle comprises a leg assembly hinged to a front end of a seat frame mount of a seat, the seat linkage assembly is rotatably connected below the seat frame mount, and the driving connecting member is connected to an end of the seat linkage assembly distal to the device for retracting seat leg at angle;

the leg assembly comprises a footrest driving link, a footrest driven link, a first footrest link, a second footrest link, and a footrest member, wherein the footrest driving link and the footrest driven link are hinged to a front end of the seat frame mount respectively, an end of the first footrest link is hinged to the footrest driving link, an opposite end of the first footrest link is hinged to an end of the footrest member, an end of the second footrest link is hinged to the footrest driven link, and an opposite end of the second footrest link is hinged to a middle of the footrest member; the footrest member comprises a footrest plate mounting surface used to mount a footrest plate, wherein the footrest plate mounting surface is configured to be retracted below the seat frame mount and is configured to be oblique with respect to a horizontal plane upon the leg assembly being retracted to a limit position; wherein an included angle between the footrest plate mounting surface and a horizontal plane is configured to be 20°-26° upon the leg assembly being retracted to a limit position; wherein a distance from a connecting point between the second footrest link and the footrest member to the footrest plate mounting surface is less than a distance from a connecting point between the first footrest link and the footrest member to the footrest plate mounting surface;

an interior side of the seat frame mount is provided with a mounting platform, wherein a height of the mounting platform is lower than an upper edge of the seat frame mount, and a plane where the mounting platform is positioned is a seat frame mounting surface; and a vertical distance H1 between a highest point where the seat frame mount is positioned on the seat frame mounting surface and a lowest point of the driving connecting member is not greater than 270 mm.

5. The seat support according to claim 4, wherein a vertical distance H2 between a highest point where the seat frame mount is positioned on the seat frame mounting surface and a highest point of the footrest plate mounting surface is configured to be not greater than 50 mm upon the seat support being retracted to a limit position.

6. The seat support according to claim 4, wherein the seat linkage assembly comprises a leg link and a seat frame linkage assembly, the seat linkage assembly is connected to the leg assembly by means of the leg link, and the seat frame linkage assembly comprises a first frame link, an intermediate linkage rod, and a second frame link all hinged in sequence; and the first frame link and the second frame link are hinged to the seat frame mount respectively, the first frame link, the intermediate linkage rod, the second frame link and the seat frame mount constitute a four-link mechanism, and the leg link is hinged to the intermediate linkage rod.

7. The seat support according to claim 6, wherein the seat linkage assembly further comprises a lateral plate linkage assembly, the lateral plate linkage assembly comprises a mounting lateral plate and a translating linkage assembly, and the translating linkage assembly is hinged between the seat frame linkage assembly and the mounting lateral plate.

8. The seat support according to claim 7, wherein the translating linkage assembly comprises a first link, a second link, a first crank, a first intermediate link, a second intermediate link, and a second crank;

an end of the first link is hinged to the first crank, an opposite end of the first link is hinged to the intermediate linkage rod, an end of the second link is hinged to the second crank, and an opposite end of the second link is hinged to the intermediate linkage rod; and the first crank and the second crank are hinged to a front end and a middle of the mounting lateral plate respectively, and the first intermediate link and the second intermediate link are hinged between the first crank and the second crank.

9. A seat unit, comprising a seat frame mount, a seat linkage assembly, a driving connecting member, a device for retracting seat leg at angle, and a backrest assembly, wherein the device for retracting seat leg at angle comprises a leg assembly hinged to a front end of a seat frame mount of a seat, the seat linkage assembly is rotatably connected below the seat frame mount, the driving connecting member is connected to an end of the seat linkage assembly distal to the device for retracting seat leg at angle, the backrest assembly comprises a backrest mounting member, and the backrest mounting member is used to connect and adjust a seat backrest;

the leg assembly comprises a footrest driving link, a footrest driven link, a first footrest link, a second footrest link, and a footrest member, wherein the footrest driving link and the footrest driven link are hinged to a front end of the seat frame mount respectively, an end of the first footrest link is hinged to the footrest driving link, an opposite end of the first footrest link is hinged to an end of the footrest member, an end of the second footrest link is hinged to the footrest driven link, an opposite end of the second footrest link is hinged to a middle of the footrest member, and the footrest member comprises a footrest plate mounting surface used to mount a footrest plate;

upon the seat unit being in a seated position, the leg assembly is configured to be retracted to a limit position, the footrest plate mounting surface is configured to be retracted below the seat frame mount and is configured to be oblique with respect to a horizontal plane; and a highest point of the seat frame mount is configured to be higher than a highest point of the backrest mounting member upon the seat unit being in a lying position.

10. The seat unit according to claim 9, wherein the backrest assembly further comprises a seat frame connecting part, a backrest connecting member, and a backrest restricting member;

a middle of the seat frame connecting part is fixedly connected to the seat frame mount, both ends of the seat frame connecting part are hinged to the backrest mounting member and the backrest restricting member respectively, an end of the backrest connecting member is hinged to a middle of the backrest mounting member, an opposite end of the backrest connecting member is hinged to the backrest restricting member, the backrest restricting member is hinged to a back end of a mounting lateral plate by means of a connecting rod; and the backrest restricting member and the backrest connecting member are configured to drive the backrest mounting member to rotate backward upon the seat frame connecting part and the seat frame mount being moved forward and upward obliquely.

11. The seat unit according to claim 10, wherein a distance H3 between the footrest plate mounting surface and a highest point of the backrest mounting member is configured to be not less than 300 mm upon the seat unit being in a lying position.

12. The seat unit according to claim 11, wherein a maximum adjustable angle of the backrest mounting member is configured to be not less than 45° upon the seat unit being adjusted from an extending position to a lying position.

13. The seat unit according to claim 11, wherein an included angle β between a central line of the backrest mounting member and a horizontal plane is configured to be not greater than 20° upon the seat unit being in a lying position.

* * * * *